US005228526A

United States Patent [19]

Vshivkov et al.

[11] Patent Number: 5,228,526

[45] Date of Patent: Jul. 20, 1993

[54] OVERFLOW VALVE OF DRILL STRING

[76] Inventors: Andrei N. Vshivkov, ulitsa Pushkina, 11, kv. 131; Anatoly M. Kochnev, prospekt Dekabristov, 16, kv. 46; Gennady A. Schelkonogov, ulitsa Voroshilova, 37/8V, kv. 170; Vladimir B. Goldobin, ulitsa Pozharskogo, 11, kv. 133; Mikhail G. Bobrov, ulitsa Jursha, 56, kv. 135, all of Perm, U.S.S.R.

[21] Appl. No.: 655,432

[22] PCT Filed: Jun. 23, 1989

[86] PCT No.: PCT/SU89/00177

§ 371 Date: Aug. 20, 1991

§ 102(e) Date: Aug. 20, 1991

[87] PCT Pub. No.: WO91/00412

PCT Pub. Date: Jan. 10, 1991

[51] Int. Cl.[5] ..... E21B 21/10

[52] U.S. Cl. ..... 175/317; 166/326

[58] Field of Search ..... 175/317, 324; 166/319, 166/326

[56] References Cited

U.S. PATENT DOCUMENTS

| | | | |
|---|---|---|---|
| 3,005,507 | 10/1961 | Clark, Jr. et al. | 175/324 |
| 3,276,523 | 10/1966 | Olive | 166/326 X |
| 3,997,009 | 12/1976 | Fox | 166/326 X |
| 4,574,894 | 3/1986 | Jadwin | 175/317 |

FOREIGN PATENT DOCUMENTS

| | | | |
|---|---|---|---|
| 2486996 | 1/1982 | France . | |
| 907365 | 10/1962 | United Kingdom | 166/326 |
| 2093566 | 12/1982 | United Kingdom . | |

OTHER PUBLICATIONS

M. T. Gusman et al., "Zaboinye vintovye dvigateli diya burenia skvazhin", 1981, Nedra, (Mskva), cf. p. 21, FIG. 8.

SU, AI, 898028 (Permsky Filial Vsesojuznogo Nauchno-Issledovatelskogo Instituta Burovoi Tekhniki), Jan. 25, 1982 (25.01.82), cf. FIG. 1.

*Primary Examiner*—William P. Neuder

*Attorney, Agent, or Firm*—Beveridge, DeGrandi, Weilacher & Young

[57] ABSTRACT

The invention relates to valves for wells.

The overflow valve of a drill string comprises a hollow body (1) with side ports (2), a seat (4) which is part of the inner surface of the body (1), a shut-off element which is in fact an elastic sleeve (3) fitted with its one end in the body (1) and positioned therein with a gap (6). An effuser (7) is provided at the other end of the sleeve (3). Elimination of movable parts and units, increasing tightness of closing the passage for fluid to flow, decreasing hydraulic resistance of the overflow valve to the flow minimize wear and failure of the components and enhances operating reliability and durability of the valve.

14 Claims, 5 Drawing Sheets

OVERFLOW VALVE OF DRILL STRING

TECHNICAL FIELD

The invention relates to valves for wells, and, more particularly, it relates to a drill string overflow valve.

BACKGROUND ART

There is known an overflow valve (U.S. Pat. No. 3,005,507), comprising a hollow body with side ports which accommodates a spring-loaded sleeve with provision for moving along the body, while the side ports area carries another sleeve with a seat to interact with the spring-loaded sleeve. In the original position the spring-loaded sleeve is in the uppermost position, the side ports of the body below the spring-loaded sleeve are open allowing fluid to freely pass from the inner space of a drill string into the well and in the opposite direction. When running a drill string with an overflow valve into the well filled in with fluid, as well as when pulling it out, the spring-loaded sleeve is held in the uppermost position due to the spring elastic force. As this takes place, the side ports of the body are open to allow fluid outgoing from the well to fill in the inner space of the drill string as it is run into the well. As the drill string is pulled out, fluid flows from the inner space of the drill string into the well.

When drilling fluid is pumped under pressure into the drill string, the spring-loaded sleeve is brought to the lowermost position with the drilling fluid flow and is tightly pressed against the seat of the fixed sleeve. Thus, the spring-loaded sleeve closes the side ports of the body. The overflow valve is shut off. With the delivery of drilling fluid into the drill string cut off, the spring-loaded sleeve is brought to the uppermost position due to the spring elastic force, the side ports of the body being open to enable fluid to freely pass from the inner space of the drill string into the well and in the opposite direction. The overflow valve is open. During operation of the valve, the sleeves are subject to excessive wear, the springs fail, become no more elastic and break. The sleeves also collide when in operation, which results in their breakdown and, hence, in failure of the overflow valve. The overflow valve in question features a large number of components in need of high surface finish and accuracy. All this fails to ensure reliable and trouble-free operation of the overflow valve.

There is known an overflow valve (FR, A, 2,486,996), comprising a hollow body with side ports which accommodates a sleeve with holes. Fitted inside the sleeve is a seat to interact with a shut-off element located inside the hollow body, The shut-off element is in fact a spring-loaded rod whose lower and carries a disc and a cup seal.

In the original position the spring-loaded rods holds the disc and cup seal in the uppermost position. In doing so, a gap is provided between the disc, cup seal and seat through which fluid inside the overflow valve can freely pass into the well. Such is the condition of the overflow valve when the drill string is run into the well filled in with fluid and when it is pulled out.

When drilling fluid is pumped under pressure through the drill string into the overflow valve, the rod goes down under the action of the drilling fluid flow to close the gap between the seat and disc. The overflow valve is shut off. Drilling fluid flows through the sleeve holes to downhole mechanisms. With the delivery of drilling fluid into the overflow valve cut off, the rod backs the disc away from the seat due to the spring elastic force, and the overflow valve becomes open. The known overflow valve is characterized by excessive wear and premature failure of its components. The valve also features coil springs subject to ageing and breakdown which result in failure of the overflow valve. Besides, the drilling fluid flow in the known overflow valve passes mostly through the sleeve holes whose flow section is some minor part of that of the drill string opening. Hence, the hydraulic resistance of the overflow valve is large. Excessive wear and premature failure of the components are common. All this affects operating reliability and durability of the overflow valve.

There is known a drill string overflow valve (SU, A, 898,028), comprising a hollow body with side ports, a seat and a shut-off element fitted inside the hollow body.

In the known drill string overflow valve, the shut-off element is in fact a spring-loaded plunger fitted to which is a sleeve with holes and a turret. The body is provided with a stepped cage with a turret inside. In its lower part, the spring-loaded plunger is plugged, provided with holes and a ring lug. In the original position, the spring-loaded plunger is in the uppermost position. The holes of the seat and sleeve of the spring-loaded plunger are open. The inner upper part of the drill string overflow valve communicates with the well. As the drill string with the overflow valve is run into the well, the plunger is held in the uppermost position, fluid entering the inner upper part of the overflow valve and filling in the drill string through the side ports provided in the body, holes provided in the seat, sleeve and plunger, as well as through the gap between the turret and stepped cage. As the drill string is pulled out, fluid passes from the drill string into the well. When drilling fluid is pumped under pressure into the drill string, the plunger is brought to the lowermost position by the drilling fluid flow, the plunger holes open and the drilling fluid passes through into the lower inner part of the overflow valve and further to downhole mechanisms. With the delivery of drilling fluid into the drill string cut off, the plunger moves to the uppermost position due to the spring elastic force, the plunger holes close and holes provided in the plunger sleeve and seat open. The overflow valve is open.

The known overflow valve of the drill string comprises a large number of movable parts and units, a spring which loses its elasticity under the well conditions, becomes brittle and break, and seals with are subject to wear.

The small holes for fluid to pass are a source of high hydraulic resistance and, hence, of additional losses. The plunger plugged in its lower part impedes the main flow of drilling fluid delivered to downhole mechanisms. All this affects operating reliability and durability of the overflow valve.

DISCLOSURE OF THE INVENTION

The invention is aimed at the provision of an overflow valve of a drill string with such a constructional arrangement that minimizes wear and failure of its components and, hence, enhances higher operating reliability and durability through eliminating movable parts and units, increasing tightness of closing the passage for fluid to flow, and decreasing hydraulic resistance of the overflow valve to the flow.

The aforesaid object is accomplished by that in an overflow valve of a drill string comprising a hollow body with side ports, a seat, a shut-off element fitted inside the hollow body, according to the invention, the shut-off element is in fact an elastic sleeve fitted in the hollow body with its upper end, the first one on the way of the drilling fluid flow, and positioned therein with a gap so that it can close the side ports area of the part of the hollow body below the side ports and the seat which is part of the inner surface of the hollow body, an effuser being provided at the lower end of the elastic sleeve in the seat area.

It is expedient that the overflow valve of the drill string comprise a casing provided between the inner surface of the hollow body and the elastic sleeve in the side ports area, a gap being allowed between the casing and the inner surface of the body.

It is also expedient that gates be provided on the elastic sleeve in the side ports area of the hollow body.

It is expedient that the side ports of the hollow body be made as slots.

The herein-disclosed overflow valve of the drill string is simple in design, has a small number of components, and is characterized by the ease of manufacture, small labour input, high operating reliability and durability. The overflow valve of the drill string features a low hydraulic resistance owing to an increased flow section of the passage for fluid to flow and high throughput capacity. The high tightness of closing the passage for fluid to flow ensured by a reliable seal makes impossible the passage of inefficient drilling fluid flows and, hence, the premature failure of the components.

BRIEF DESCRIPTION OF THE DRAWINGS

In what follows the present invention will now be disclosed in a detailed description of an illustrative embodiment thereof with reference to the accompanying drawings, wherein.

BEST MODE OF CARRYING OUT THE INVENTION

Figure 1:
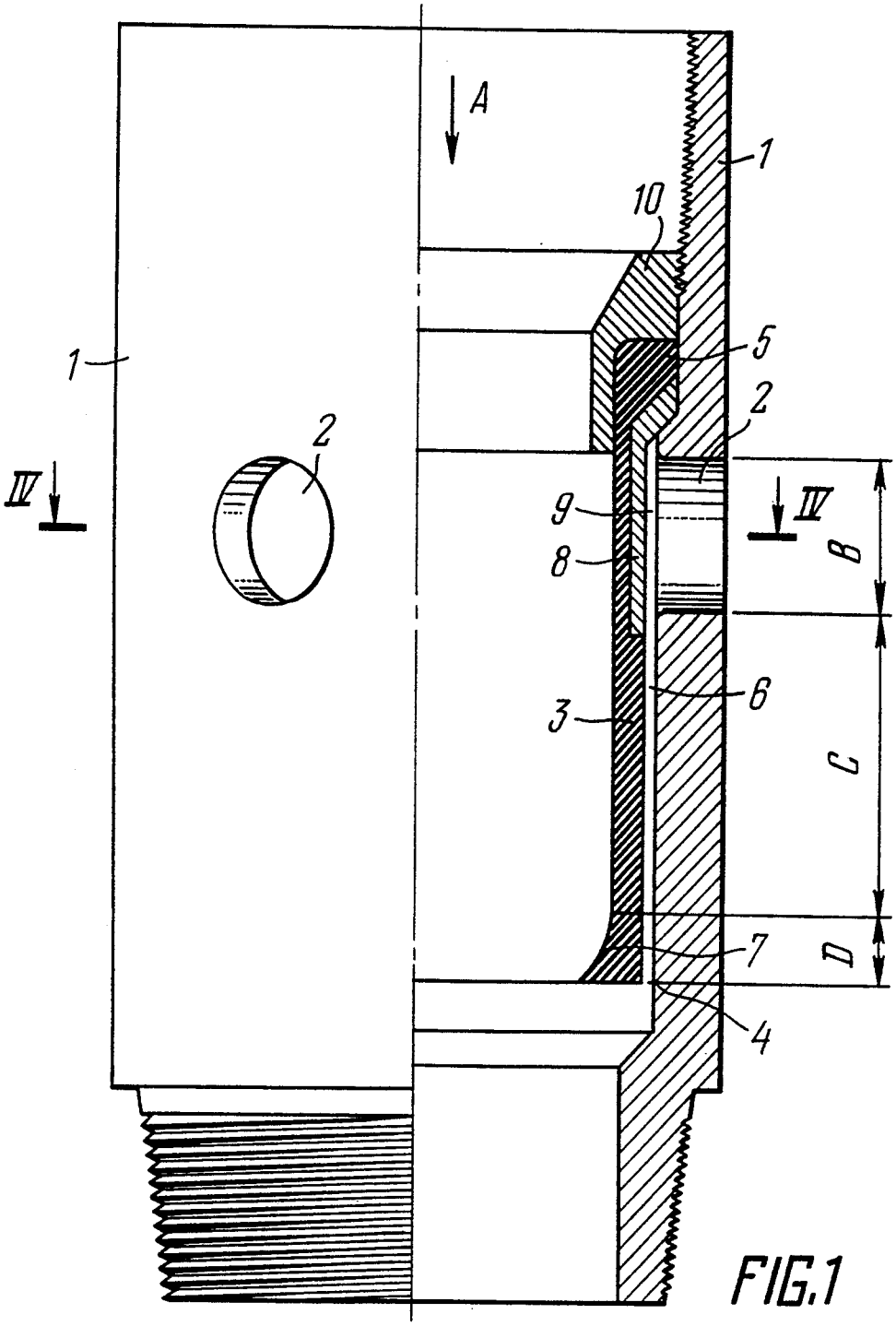
FIG. 1 is a general schematic view of an overflow valve of a drill string partly in longitudinal section, according to the invention.

The overflow valve of the drill string comprises a hollow body 1 (FIG. 1) with side ports 2 of circular section, a shut-off element which is in fact an elastic sleeve 3, and a seat 4 which is part of the inner surface of the hollow body 1. The elastic sleeve 3 is fitted in the body 1 and secured therein with its upper end 5, the first one on the way of the drilling fluid flow. The direction of the drilling fluid flow is shown with the arrow A.

The elastic sleeve 3 is fitted in the hollow body 1 with a gap 6 so that it can close the area B of the side ports 2 of the body 1, the part C of the body 1 below the side ports 2 of the body 1, and the area D of the seat 4. An effuser or expansion enhances 7 is provided at the lower end of the elastic sleeve 3 in the area D of the seat 4.

The components of the drill string overflow valve are made of alloy structural steel. The elastic sleeve 3 is made of wear-resistant rubber.

The overflow valve of the drill string also comprises a casing 8 provided between the inner surface of the hollow body 1 and the elastic sleeve 3 in the area B of the side ports 2 of the body 1, a gap 9 being allowed between the casing 8 and the inner surface of the body 1.

The casing 8 serves to prevent the destructive effect of the fluid flow, as well as of the edges of the side ports 2 of the body 1 on the elastic sleeve 3 and, hence, to ensure integrity of the elastic sleeve for a longer operating time of the overflow valve. The gaps 6 and 9 may quantitatively differ. The elastic sleeve 3 is fitted in the hollow body 1 with its upper end 5 by means of a bushing 10. The upper and lower parts of the hollow body 1 are provided with threads to connect the overflow valve to the drill string and downhole mechanisms (drill string and downhole mechanisms not shown in FIG. 1). The gap 9 between the casing 8 and the body 1 serves to increase the cross-sectional area of the passage for fluid to pass from the inner space of the overflow valve of the drill string into the well and in the opposite direction and to decrease hydraulic resistance of the valve to the flow. The bushing 10 serves to secure the upper end 5 of the elastic sleeve 3, the first one on the way of the drilling fluid flow, in the body 1, provide sealing, and prevent wear and breakage of the elastic sleeve 3 with the drilling fluid flow. The elastric sleeve 3 is intended for closing the passage for fluid to flow. Since the sleeve 3 is elastic, the fine drilling cuttings that penetrated the gap 6 between the body 1 and the elastic sleeve 3 are enveloped by the elastic sleeve 3 and, hence, the tightness of closing the passage for fluid to flow remains unaffected. Due to its elasticity, the elastic sleeve 3 regains its original form and dimensions under the action of elastic force in case the delivery of drilling fluid under pressure is cut off. This enables drilling fluid to freely pass from the inner space of the overflow valve of the drill string into the well and in the opposite direction. The seat 4 which is part if the inner surface of the hollow body 1 is designed to interact with the elastic sleeve 3 and initially to close the passage for fluid to flow, hereby ensuring an appropriate pressure difference between the inner and outer spaces of the overflow valve of the drill string. The upper end 5 of the elastic sleeve 3 serves to secure it in the body by means of the bushing 10 and provide reliable sealing to prevent leakage of drilling fluid through gaps between the bushing 10 and the body 1 from the inner space of the overflow valve of the drill string into the well with downhole mechanisms in operation.

The gap 6 between the elastic sleeve 3 and the hollow body 1 is designed for the passage of fluid from the inner space of the overflow valve of the drill string into the well and in the opposite direction. The gap 6 has a large cross-sectional area and, hence, a low hydraulic resistance which facilitates filling of the drill string with fluid outgoing from the well and results in no excessive wear of the components covered by the flow.

Figure 2:
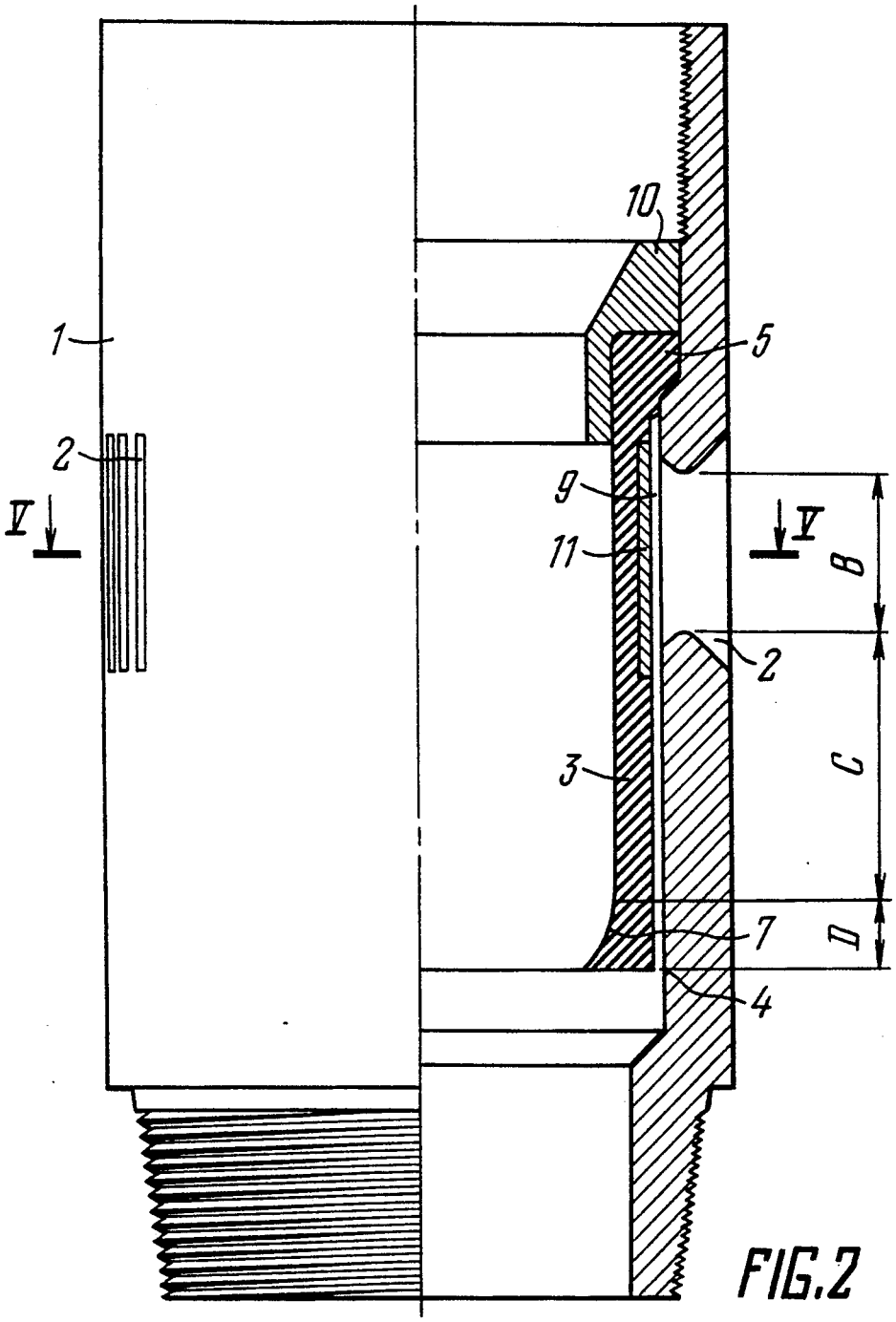
FIG. 2 is a general schematic view of an overflow valve of a drill string with side ports of the body made as slots partly in longitudinal section.

The effuser or expansion enhancer 7 provided at the lower unfastened end of the elastic sleeve 3 is designed to automatically close the overflow valve of the drill string and hold it in this position with downhole mechanisms in operation as long as drilling fluid is pumped under pressure. As shown in FIG. 2 effuser or expansion enhancer 7 features an inwardly extending projection having a curved surface adapted for contact with flowing drilling fluid. There is an embodiment of the overflow valve wherein the side ports 2' of the body 1 (FIG. 2) can be made as slots. The number and size of the slots are determined by technological routine. The hollow body 1 serves to accommodate all the components of the overflow valve of the drill string, position and secure them, and ascertain the mutual arrangement of the components.

The side ports 2' of the body 1 are designed to bring the inner and outer spaces of the overflow valve of the drill string in communication with each other. With the side ports 2' of the body 1 made as slots, it is possible to separate large drilling cuttings from fluid coming into the overflow valve of the drill string out of the well and, hence, prevent the gap 6 between the body 1 and the elastic sleeve 3 from being clogged during operation of the overflow valve of the drill string. The overflow valve also comprises semi-cylindrical protection members 11 fitted to the outer surface of the elastic sleeve 3 in the area B of the side ports 2'. The number of the semi-cylindrical protection members 11 is equal to that of the side ports 2' of the body 1. There is another embodiment of the overflow valve comprising the body 1 provided with the side ports 2' made as slots, the elastic sleeve 3 being fitted in the body 1 with the gap 6 with its upper end 5 secured. In the area B of the side ports 2' of the body 1 there are provided the semi-cylindrical protection members 11 fitted to the inner surface of the sleeve 3. The effuser 7 is provided at the lower unfastened end of the elastic sleeve 3.

Figure 4:
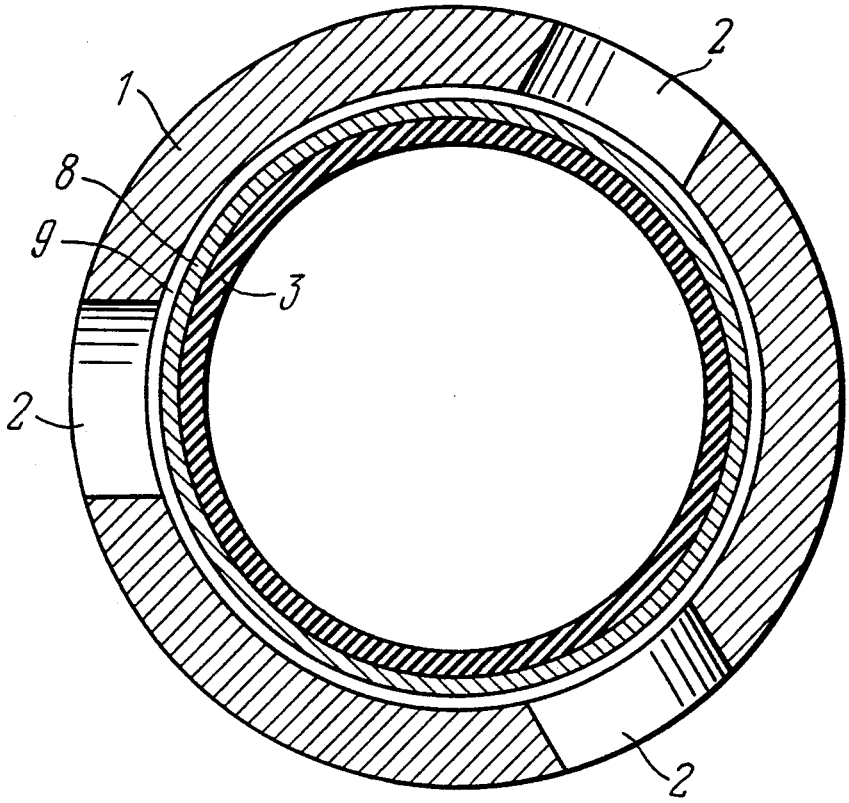
FIG. 4 is a cross-sectional view taken along line IV—IV in FIG. 1.

FIG. 4 is a cross-sectional view taken along line IV—IV in FIG. 1 of the overflow valve of the drill string. FIG. 4 shows the three side ports 2 of the body 1, the casing 8 fitted in the body 1 with the gap 9, and the elastic sleeve 3.

Figure 5:
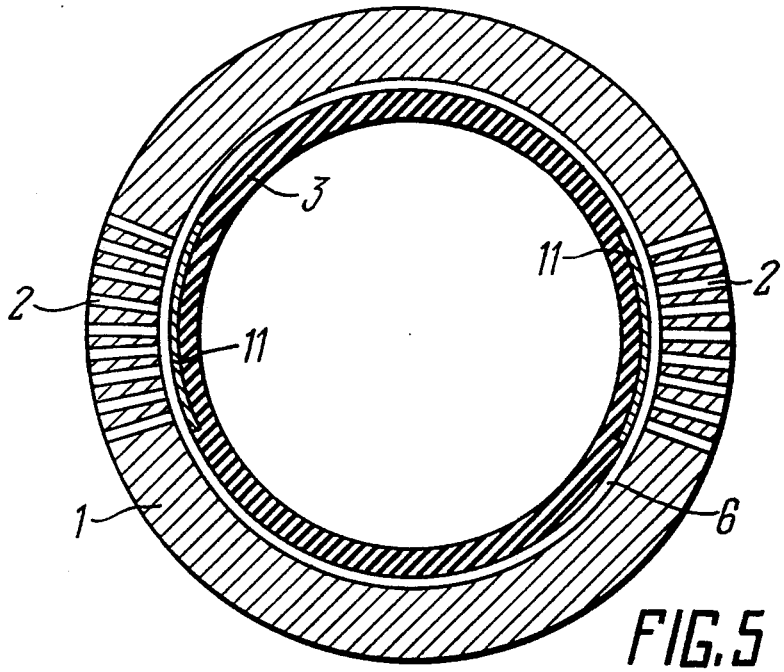
FIG. 5 is a cross-sectional view taken along line V—V in FIG. 2.

FIG. 5 is a cross-sectional view taken along line V—V in FIG. 2 of the overflow valve of the drill string. The side ports 2' (FIG. 5) of the body 1 are made as slots. The semi-cylindrical protection members 11 are fitted to the outer surface of the elastic sleeve 3.

Figure 3:
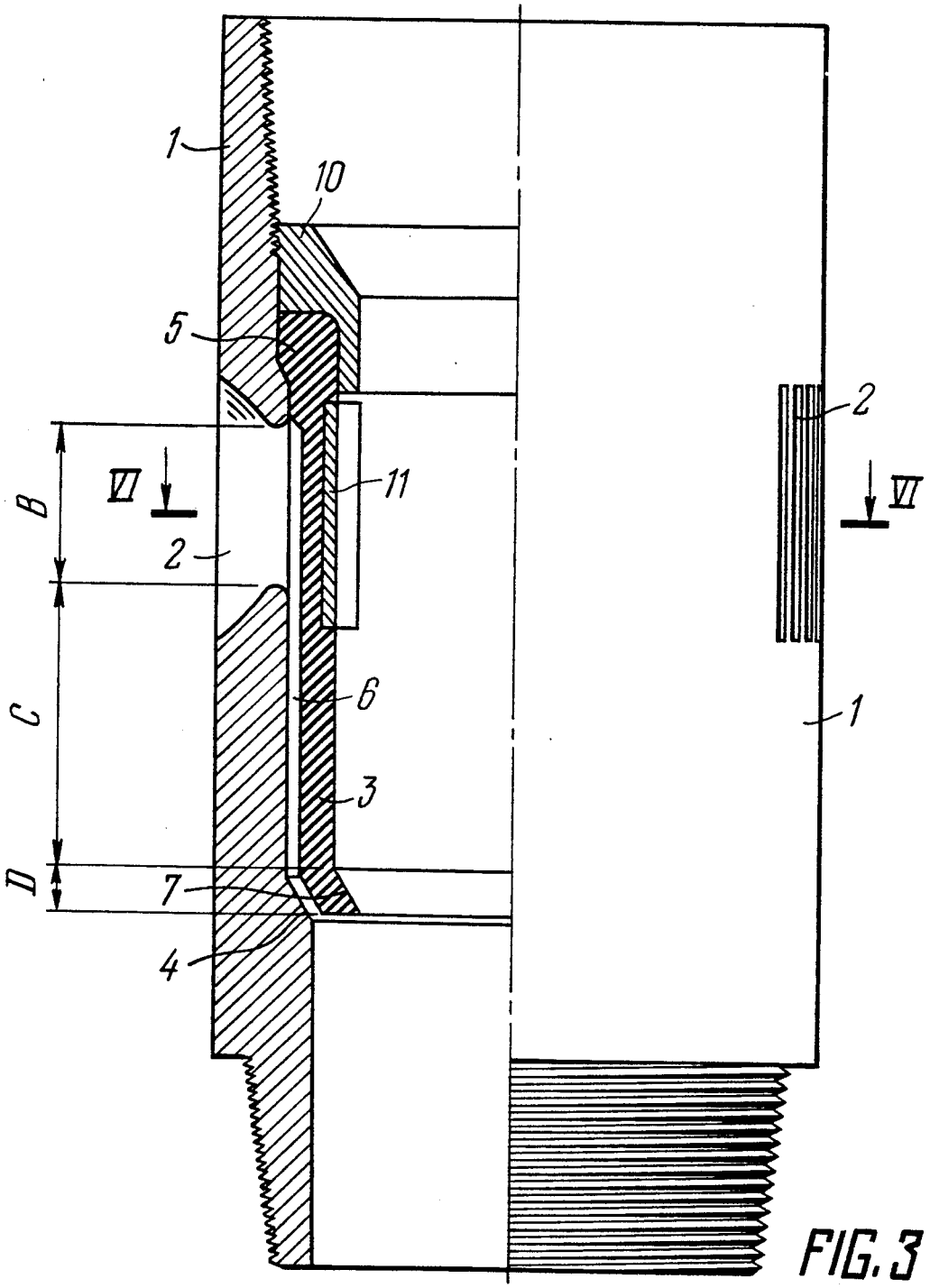
FIG. 3 is a general schematic view of an overflow valve of a drill string with gates provided on the inner surface of the elastic sleeve partly in longitudinal section.
Figure 6:
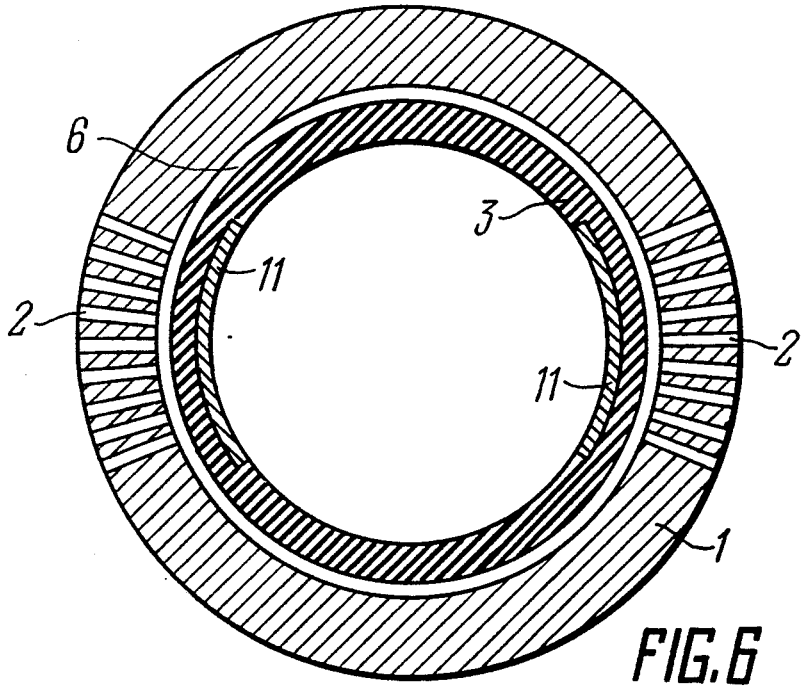
FIG. 6 is a cross-sectional view taken along line VI—VI in FIG. 3.

FIG. 6 is a cross-sectional view taken along line VI—VI in FIG. 3 of the overflow valve of the drill string. The side ports 2' (FIG. 6) of the body 1 are made as slots. The gates 11 are fitted to the inner surface of the elastic sleeve 3. The semi-cylindrical protection members 11 serve to prevent the breakdown of the elastic sleeve 3 in the area B (FIG. 3) of the side ports 2' of the body 1 in case no casing 8 (FIG. 1) is provided between the body 1 and the elastic sleeve 3.

The overflow valve of the drill string operates as follows.

The overflow valve is connected to the drill string on the one side, whereas on the other side it is connected to downhole mechanisms, say, to a screw downhole motor and a bit.

The drill string is run into the well filled in with fluid. Fluid outgoing from the well enters the side ports 2 (FIG. 1) of the body 1, fills in the gap 9, flows through the gap 6 into the overflow valve of the drill string, filling in the drill string. The fluid flow directed along the generatrix of the elastic sleeve 3 in the gap 6 brings about no excessive wear of the sleeve 3. With pumps actuated and drilling fluid delivered along the arrow A into the drill string, the drilling fluid flow when passing through the effuser 7 enlarges the unfastened end of the elastic sleeve 3 which closes the gap 6 in the area D of the seat 4. This being the case, there occurs a pressure difference inside the overflow valve of the drill string and in the well. The elastic sleeve 3 enlarges and is pressed against the inner surface of the body 1 along the entire length of closing the areas D, B and part C of the body 1.

Due to the drilling fluid flow the bushing 10 holds the upper end 5 of the elastic sleeve 3 tighter, seals it more reliably and prevents its breakdown. The overflow valve of the drilling string closes, and the entire drilling fluid flow goes to downhole mechanisms through the inner space of the valve.

With pumps shut down and the delivery of drilling fluid into the drill string cut off, the pressure in the drill string and in the well levels off. Due to the elastic force, the elastic sleeve 3 regains its original form and dimensions. The gap 6 is formed again, and thus the hydraulic duct connecting the inner space of the overflow valve of the drill string with the well is restored. The overflow valve of the drill string opens. As the drill string is pulled out, the fluid level goes up, and, hence, fluid freely passes from the drill string into the well through the gap 6, the gap 9, and the side ports 2 of the body 1 of the overflow valve of the drill string.

With the semi-cylindrical protection members 11 (FIG. 2) provided on the overflow valve, it operates in much the same way as the one outfitted with the casing 8. Yet with the valve closed, the elastic sleeve 3 is pressed directly against the inner surface of the body 1 and the inner surface of the body 1 in the area D, whereas the semi-cylindrical protection members 11 fitted to the outer surface of the sleeve 3 are pressed against the inner surface of the body 1 in the area B. Should the semi-cylindrical protection members 11 (FIG. 3) be fitted to the inner surface of the sleeve 3, the sleeve 3 with the semi-cylindrical protection members 11 fitted to it is pressed against the inner surface of the body 1 in the area B to prevent leakage of drilling fluid from the inner space into the well and provide reliable sealing.

The side ports 2' of the body 1 made as slots prevent the penetration of large drilling cuttings in fluid into the gap 6 as the drill string is filled in with fluid outgoing from the well and, hence, ensure reliable tightness of the overflow valve of the drill string.

The herein-disclosed valve comprises no movable parts and units, viz. sources of excessive wear and attrition, therefore, it can operate for a long period of time with no need of part replacement.

The tightness of the overflow valve of the drill string is ensured by the elastic sleeve 3. The passage of fluid causing damage to the components into the closed overflow valve of the drill string is thus prevented.

The overflow valve of the drill string has a large flow section of the passage for fluid to pass from the inner space into the well and in the opposite direction and for the main drilling fluid flow to downhole mechanisms. Therefore, the hydraulic resistance of the overflow valve of the drill string is low, hence, the components are little worn out and feature high operating reliability and durability.

INDUSTRIAL APPLICABILITY

The invention can find application in the operation of downhole mechanisms, among other things, for use on drill strings in round trips, in drilling of oil and gas wells by means od screw downhole motors, turbodrills and in rotary drilling.

We claim:

1. An overflow valve of a drill string comprising a hollow body (1) with side ports (2), a seat (4), a shut-off element fitted in the hollow body (1), characterized in that the shut-off element is in fact an elastic sleeve (3) fitted in the hollow body (1) with an upper end (5) of said elastic sleeve being the first one on the way of drilling fluid flow, and said elastic sleeve being positioned within said hollow body so as to form a gap (6) therebetween, said elastic sleeve being adapted for expanding from a normal state to a second state upon drilling fluid flow therethrough, wherein in the second state the side ports (2) are closed by said elastic sleeve and a lower end of said elastic sleeve positioned below the side ports (2) is placed in contact with the seat (4) which is part of the inner surface of the hollow body (1), said elastic sleeve including an expansion enhancer (7) provided at the lower end of the elastic sleeve (3) in an area (D) of the seat (4).

2. An overflow valve of a drill string as claimed in claim 1, characterized in that it comprises a casing (8) provided between the inner surface of the hollow body (1) and the elastic sleeve (3) in the side ports (2) area (B), a gap (9) being provided between the casing (8) and the inner surface of the body (1).

3. An overflow valve of a drill string as claimed in claim 1, characterized in that semicylindrical protection members (11) are provided on the elastic sleeve (3) adjacent the side ports (2) of the hollow body (1).

4. An overflow valve of a drill string as claimed in claim 1, characterized in that the side ports (2') of the hollow body (1) are made as slots.

5. An overflow valve of a drill string as claimed in claim 2, characterized in that the side ports (2') of the hollow body (1) are made as slots.

6. An overflow valve of a drill string as claimed in claim 3, characterized in that the side ports (2') of the hollow body (1) are made as slots.

7. An overflow valve of a drill string as claimed in claim 1 wherein said expansion enhancer includes a projection which extends further inwardly within said hollow body than remaining components of said elastic sleeve.

8. An overflow valve of a drill string as claimed in claim 7 wherein said expansion enhancer projection includes a curved drilling fluid contact surface.

9. An overflow valve of a drill string, comprising:

a hollow body, said hollow body having an exterior surface and an interior surface with said interior surface defining a through-hole extending between a first and second end of said hollow body, said hollow body further including side ports extending from said exterior surface and opening into the through-hole;

a shut off element which includes an elastic sleeve, said elastic sleeve having a first end secured to the interior surface of said hollow body between the first end of said hollow body and said side ports, said elastic sleeve further including a free end positioned between said side ports and the second end of said hollow body;

said elastic sleeve having an inward bias such that a gap is provided between said elastic sleeve and the interior surface of said hollow body when said elastic sleeve is in a non-deflected state, said gap originating at a position between the first end of said elastic sleeve and said side ports and extending to the free end of said elastic sleeve such that, when said elastic sleeve is in a nondeflected state, fluid is adapted to flow through said ports, through said gap and into said through-hole during insertion of the drill string into a well cavity and such that fluid is adapted to flow out from said through-hole, through said gap and out of said ports during removal of the drill string from the well cavity, and said elastic sleeve being dimensioned and arranged such that said ports are sealed when drilling fluid is introduced into the drill string so as to deflect said elastic sleeve.

10. An overflow valve as recited in claim 9 wherein said elastic sleeve includes an expansion enhancer which includes an inwardly extending projection provided at the free end of said elastic sleeve.

11. An overflow valve as recited in claim 9 further comprising a cylindrical casing supported within a recess formed in said elastic sleeve and positioned so as to cover said side ports upon an outward expansion of said elastic sleeve.

12. An overflow valve as recited in claim 9 comprising semi-cylindrical protection members supported by said elastic sleeve.

13. An overflow valve as recited in claim 12 wherein said protection members are directly opposed from said side ports such that said protective members cover said side ports upon expansion of said elastic sleeve.

14. An overflow valve as recited in claim 12 wherein said elastic sleeve has an inner side and an exterior side that includes portions adapted for covering said side ports and said protection members are supported in recesses formed in the inner side of said elastic sleeve directly adjacent said elastic sleeve portions.

* * * * *